US010602274B2

(12) United States Patent
Takeshima et al.

(10) Patent No.: US 10,602,274 B2
(45) Date of Patent: Mar. 24, 2020

(54) AUDIO INPUT/OUTPUT DEVICE

(71) Applicants: Onkyo Corporation, Neyagawa-shi, Osaka (JP); DSP Group Ltd., Herzelia (IL)

(72) Inventors: Yoshitada Takeshima, Neyagawa (JP); Dmitri Lvov, Ramat Hasharon (IL); Yaakov Chen, Rishon Letzion (IL)

(73) Assignees: Onkyo Corporation, Osaka (JP); DSP Group Ltd., Herzelia (IL)

( * ) Notice: Subject to any disclaimer, the term of this patent is extended or adjusted under 35 U.S.C. 154(b) by 0 days.

(21) Appl. No.: 16/233,086

(22) Filed: Dec. 27, 2018

(65) Prior Publication Data

US 2019/0215608 A1 Jul. 11, 2019

Related U.S. Application Data

(60) Provisional application No. 62/613,770, filed on Jan. 5, 2018.

(51) Int. Cl.

| | |
|---|---|
| ***H04R 5/02*** | (2006.01) |
| ***H04R 5/033*** | (2006.01) |
| ***H04R 5/04*** | (2006.01) |
| ***H04R 5/027*** | (2006.01) |
| ***H04R 1/10*** | (2006.01) |
| *H04R 3/00* | (2006.01) |
| *H04R 1/40* | (2006.01) |

(52) U.S. Cl.

CPC ..... *H04R 5/0335* (2013.01); *H04R 1/1091* (2013.01); *H04R 5/02* (2013.01); *H04R 5/027* (2013.01); *H04R 5/033* (2013.01); *H04R 5/04* (2013.01); *H04R 1/1041* (2013.01); *H04R 1/1083* (2013.01); *H04R 1/406* (2013.01); *H04R 3/005* (2013.01)

(58) Field of Classification Search

CPC .... H04R 1/406; H04R 1/1041; H04R 1/1083; H04R 1/1091; H04R 3/005; H04R 5/02; H04R 5/027; H04R 5/033; H04R 5/0335; H04R 5/04

See application file for complete search history.

(56) References Cited

U.S. PATENT DOCUMENTS 6,091,832 A * 7/2000 Shurman ..... G02C 11/06 2/422
2018/0286376 A1* 10/2018 Sekiya ..... G10K 11/17853

* cited by examiner

*Primary Examiner* — Brian Ensey
(74) *Attorney, Agent, or Firm* — Shinjyu Global IP

(57) ABSTRACT

Provided is a wearable audio input/output device. The wearable audio input/output device is provided with a frame, a first audio collection unit, a second audio collection unit, and a first speaker. The frame can be mounted to a user. The first audio collection unit is provided on the frame. The second audio collection unit is provided on the frame. The second audio collection unit is arranged such that the distance between the first audio collection unit and mouth of the user is less than the distance between the second audio collection unit and the mouth of the user. The first speaker is provided on the frame between the first audio collection unit and the second audio collection unit.

6 Claims, 4 Drawing Sheets

AUDIO INPUT/OUTPUT DEVICE

CROSS-REFERENCE TO RELATED APPLICATIONS

This application claims the benefit of priority under 35 USC § 119(e) to U.S. Provisional Application No. 62/613,770, entitled "AUDIO INPUT/OUTPUT DEVICE," filed Jan. 5, 2018. The contents of that application are herein incorporated by reference in their entirety.

BACKGROUND

Technical Field

The present disclosure generally relates to an audio device. More specifically, the present disclosure relates to a wearable audio device, which can be mounted to a user and is capable of receiving audio inputs and generating audio outputs.

Background Art

Wearable audio device having an audio output element, such as a speaker, has been conventionally used and well documented in the art. Recently, in addition to being used for listening to the output audio, some wearable audio devices have been further equipped with an audio input element to receive voice commands for controlling the device, e.g. for changing volume of the output audio.

BRIEF SUMMARY

For such kind of wearable audio devices, a problem to be solved is to make sure that the audio input element can receive audio inputs that are clear.

A wearable audio input/output device according to the present disclosure includes a frame that can be mounted to a user, a first audio collection unit provided on the frame, a second audio collection unit provided on the frame, and a first speaker provided on the frame. The second audio collection unit is arranged such that the distance between the first audio collection unit and mouth of the user is less than the distance between the second audio collection unit and the mouth of the user when the frame is mounted to the user. The first speaker is provided on the frame between the first audio collection unit and the second audio collection unit.

The positional arrangement of the first audio collection unit, the first speaker, and the second audio collection unit allows the wearable audio input/output device to clearly receive audio inputs from the user, to perform effective noise-cancelling, and to allow audio outputs from the first speaker to be less affected by any noise when received by the user. In this specification, "noise" should be interpreted to include noise and also any echo resulted from the speaker. Similarly, noise-cancellation includes cancelling noise and/or echo resulted from the speaker.

BRIEF DESCRIPTION OF THE DRAWINGS

The features and advantages of the present advancement will be more readily understood by reference to the following detailed description when considered in connection with the accompanying drawings, in which.

DETAILED DESCRIPTION

The present advancement will now be described with reference to the Figures, wherein like numerals indicate similar or corresponding elements. For purpose of illustration and not to be limiting in any way, the present advancement will be described referring to a mode of usage in which the audio input/output device according to the present advancement is mounted to a user.

An audio input/output device according to the present disclosure can receive audio inputs from a user via audio collection units, such as microphones or particularly MEMS microphones, can process the received audio inputs for noise-cancellation, and can generate audio output via speakers. The device according to the present advancement can, in one instance, serve as a wearable music player in which the user controls the music player using voice commands via microphones, while the music is output by the speakers. In another instance, the device according to the present advancement can be remotely connected to a server and can serve as a communications device that sends queries to the server for obtaining information or sends voice commands to control other devices connected to the server, while the information retrieved from the server is output by the speakers.

Figure 1:
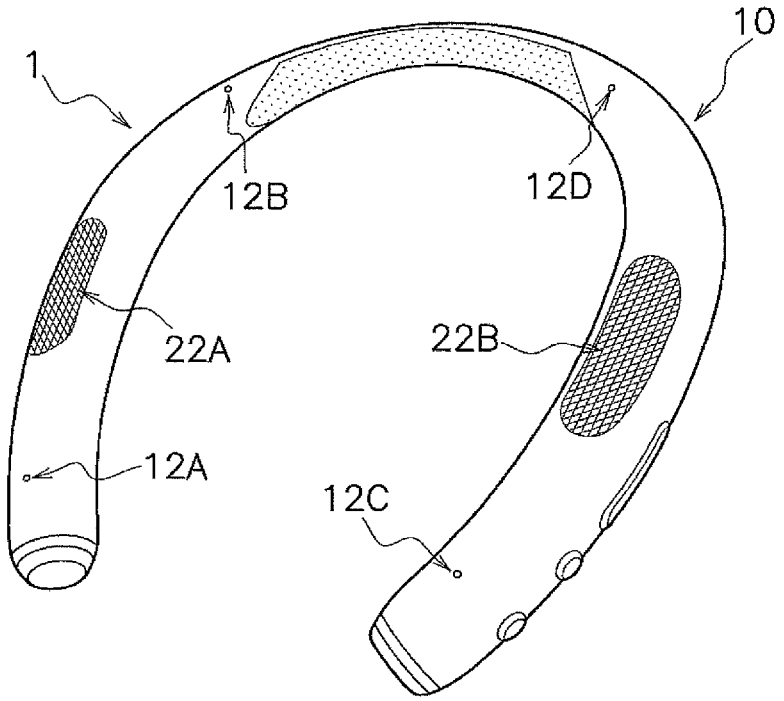
FIG. 1 is a schematic perspective view of an embodiment of an audio input/output device according to the present disclosure.
Figure 2:
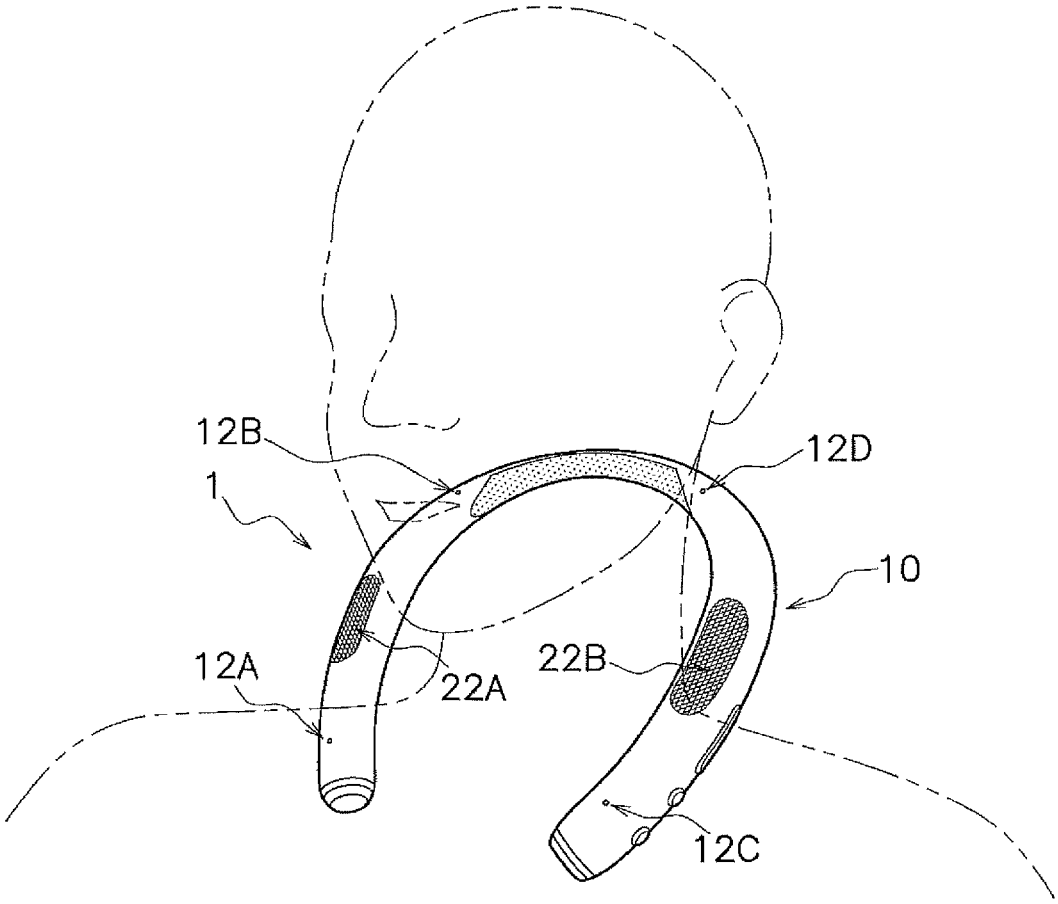
FIG. 2 shows a mode of usage of the audio input/output device according to the FIG. 1.
Figure 3:
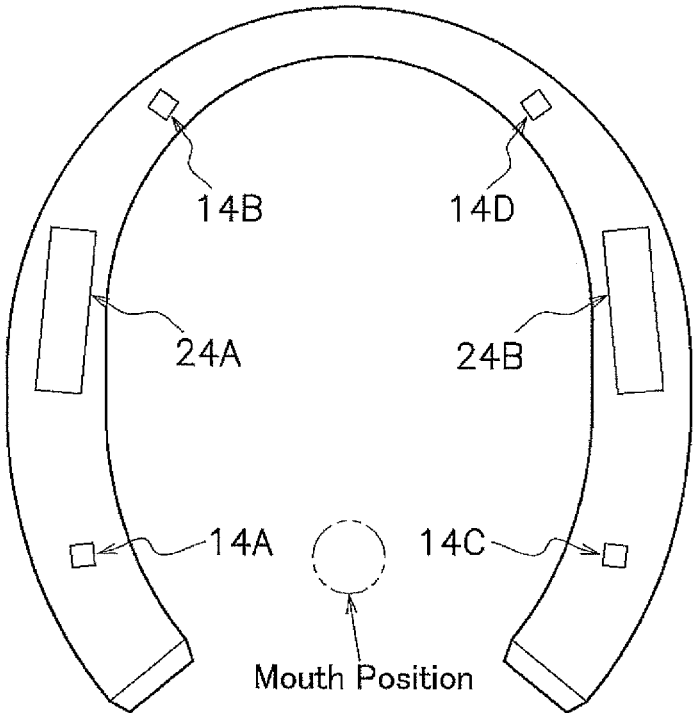
FIG. 3 shows an internal structure of the audio input/output device according to the FIG. 1.

FIG. 1 illustrates one embodiment of an exemplary audio input/output device 1 according to the present disclosure. As shown in FIG. 1, the audio input/output device 1 includes a U-shaped casing 10 (an example of "frame" according to the appended claims), and as shown in FIG. 3, the device 1 includes four microphones 14 (an example of "audio collection unit" according to the appended claims) and two speakers 24 in the U-shaped casing 10. In this embodiment as shown in FIG. 2, when mounted to the user, the U-shaped casing 10 can be arranged around the user's neck, with the open end of the U-shape being positioned on a front-side of the user and the closed end of the U-shape being positioned on a rear-side of the user. In other words, the open end of the U-shape can be closer to the user's mouth in this embodiment than the closed end. The four microphones 14, namely a first microphone 14A, a second microphone 14B, a third microphone 14C, and a fourth microphone 14D, and the two speakers 14, namely a first speaker 24A and a second speaker 24B, are provided in the casing 10 and separately from each other. In this embodiment illustrated in FIG. 1, the microphones 14 are provided within the casing 10, and voice intake holes 12 are provided on an upper surface of the casing 10 so as to allow audio signals to be received by the microphones 14. More specifically, voice intake holes 12A, 12B, 12C, 12D are respectively provided on the upper surface of the casing 10 to correspond to the first microphone 14A, the second microphone 14B, the third microphone 14C, and the fourth microphone 14D. Further, audio outlet holes 22A and 22B are respectively provided on the upper surface of the casing 10 to correspond to the first speaker 24A and the second speaker 24B so as to allow audio outputs to be transmitted from the speakers 24A and 24B to the user.

In this embodiment, the first microphone 14A is arranged near the open end of the U-shaped casing 10 and is closer to the user's mouth than the second microphone 14B is, and the first speaker 24A is positioned between the first microphone 14A and second microphone 14B. As shown in FIG. 3, the first speaker 24A can be positioned in such a way that the distance to the first microphone 14A and the distance to the second microphone 14B are substantially the same; however, the two distances do not have to be the same. Via such arrangement of the speaker and microphones, the first microphone 14A is capable of receiving audio inputs, such as voice inputs from the user, whereas the second microphone 14B can receive other audio inputs to be used for noise-cancelling. The arrangement of the first microphone 14A, the first speaker 24A, and the second microphone 14B, in this order, allows effective noise-cancelling to be achieved. Similarly, the third microphone 14C, the second speaker 24B, and the fourth microphone 14D are arranged in this order to achieve effective noise-cancelling. Specifically, the third microphone 14C is arranged near the open end of the U-shaped casing 10 closer to the user's mouth and is capable of receiving audio inputs, such as voice inputs from the user, the fourth microphone 14D is arranged further from the user's mouth to receive other audio inputs to be used for noise-cancelling, and the second speaker 24B is positioned between the third microphone 14C and the fourth microphone 14D.

Figure 4:
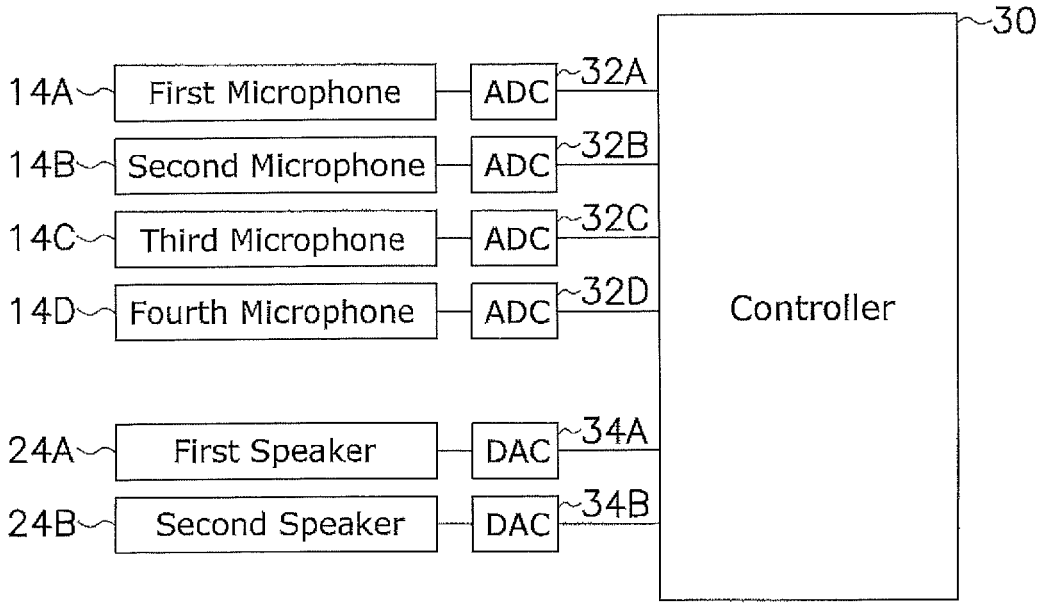
FIG. 4 is an example of the hardware configuration diagram of the audio input/output device according to the FIG. 1.

Processing such as noise-cancelling and audio recognition can be performed based on the audio signals received by the microphones 14 and, if needed, along with any reference audio signal. Specifically, in this embodiment as shown in FIG. 4, the wearable audio input/output device 1 according to the present advancement includes a controller 30 having an internal processing unit, such as a CPU, for audio processing. When the controller 30 receives respective audio inputs via the microphones 14, the controller 30 can perform noise-cancellation based on the received audio inputs. Thereafter, the controller 30, based on the post-noise-cancellation audio inputs, identifies and recognizes the voice inputs of the user and controls the device 1 according to the voice inputs, e.g. to change volume of the audio outputs, to switch songs to be played by the speakers, to send queries to a server via Internet for obtaining information, etc. All of such processing can be performed entirely within the device 1 by the controller, or can be performed in part by a server remotely connected to the device 1. For the latter case, for example, the controller 30 can perform noise-cancellation based on the received audio inputs from the microphones 14 and then send the post-noise-cancellation audio inputs to a server via a communications unit (not shown in Figures) to be analyzed or processed. Although not illustrated in FIG. 4, the controller 30 can be composed of one or more IC components, such as an Audio Processor and Controller and an Application Processor. Also, as one example illustrated in FIG. 4, the controller 30 can be connected to the microphones 14 and speakers 24 via IC components such as A/D converter(s) 32, D/A converter(s) 34, amplifier(s) (not shown in Figures), etc.

In the embodiment described above and shown in FIG. 1, four microphones 14 are provided to receive audio inputs. However, depending on the mode of usage, one or more microphones can be omitted. For example, in one different embodiment, the third microphone 14C and the fourth microphone 14D can be omitted. In this case, the first microphone 14A and the second microphone 14B will receive audio inputs and processing such as noise-cancellation and audio recognition can be performed based on the inputs from the two microphones 14A, 14B. Similarly, in the embodiment described above and shown in FIG. 1, two speakers 24A and 24B are provided; however, the second speaker 24B can be omitted.

In the embodiment described above and shown in FIG. 1, the second microphone 14B and the fourth microphone 14D are each provided for noise cancellation. However, in a different embodiment not shown in the Figures, instead of providing two separate microphones, one microphone can be provided to achieve the functions of both of the microphones 14B and 14D. In other words, one microphone can serve both as the second microphone 14B and the fourth microphone 14D for noise cancellation. For example, this one microphone can be arranged in the U-shaped casing 10 on the rear-side of the user, further from the open end of the U-shaped casing and further from the user's mouth than the first microphone 14A and the third microphone 14C. In yet another different embodiment, the second microphone 14B and the fourth microphone 14D can each be represented by a group of microphones for noise cancellation. In this arrangement, all of the individual microphones in each group can be arranged further from the open end of the U-shaped casing 10 than the first microphone 14A and the third microphone 14C.

In the embodiment described above, the first speaker 24A and the second speaker 24B serve as speakers that generate audio outputs. However, depending on the mode of usage, the first speaker 24A and the second speaker 24B can be configured to also include functions other than audio output. For example, the speakers can be configured such that they can also include functions of a vibration sensor or a microphone.

In the embodiment described above, the frame is a U-shaped casing that can be mounted to a user around the user's neck. However, the casing or the frame on which the microphones and speakers are arranged can also be in a different shape that goes around the user's neck, or it can be shaped as a headband that can be mounted around the user's head or a clip-on that can be mounted on the user's ear.

Although not described in the above embodiment, the audio input/output device 1 can further include input means to receive user's non-audio inputs to control various functions of the device 1. For example, input buttons can be provided on the casing to receive inputs associated with ON/OFF of the device, volume of the speakers, etc.

Although the present advancement has been illustrated and described herein with reference to the preferred embodiments and examples thereof in connection with the drawings, it will be readily apparent to those of ordinary skill in the art that other embodiments and examples can perform similar functions and/or achieve similar results. All such equivalent embodiments and examples shall be within the spirit and the scope of the present advancement, and are intended to be covered by the following claims.

What is claimed is:

1. A wearable audio input/output device comprising:

a frame that can be mounted to a user;

a first audio collection unit provided on the frame;

a second audio collection unit provided on the frame, the second audio collection unit arranged such that a distance between the first audio collection unit and a mouth of the user is less than a distance between the second audio collection unit and the mouth of the user; and a first speaker provided on the frame between the first audio collection unit and the second audio collection unit.

2. The wearable audio input/output device according to claim 1, further comprising:

a third audio collection unit provided on the frame;

a fourth audio collection unit provided on the frame, the fourth audio collection unit arranged such that a distance between the third audio collection unit and the mouth of the user is less than a distance between the fourth audio collection unit and the mouth of the user; and a second speaker provided on the frame between the third audio collection unit and the fourth audio collection unit.

3. The wearable audio input/output device according to claim 1, wherein the frame is shaped to be mounted around the neck of the user.

4. The wearable audio input/output device according to claim 1, wherein the frame is a U-shaped casing.

5. The wearable audio input/output device according to claim 4, wherein the first audio collection unit is provided closer to a tip end of the U-shaped casing than the second audio collection unit is.

6. The wearable audio input/output device according to claim 1, further comprising:

a controller configured to receive audio inputs via the first audio collection unit and the second audio collection unit and perform noise-cancellation based on the received audio inputs.

* * * * *